US007055267B2

(12) United States Patent
Wilson et al.

(10) Patent No.: US 7,055,267 B2
(45) Date of Patent: Jun. 6, 2006

(54) WATERPROOF FOOTWEAR CONSTRUCTION

(75) Inventors: Frederic T. Wilson, Kansas City, MO (US); Clare King, Providence, RI (US); Peter Bastianelli, Fife (GB)

(73) Assignee: BHA Technologies, Inc., Kansas City, MO (US)

( * ) Notice: Subject to any disclaimer, the term of this patent is extended or adjusted under 35 U.S.C. 154(b) by 0 days.

(21) Appl. No.: 10/426,708

(22) Filed: Apr. 30, 2003

(65) Prior Publication Data

US 2004/0216332 A1 Nov. 4, 2004

(51) Int. Cl.
*A43B 23/07* (2006.01)

(52) U.S. Cl. ..... 36/55; 36/10

(58) Field of Classification Search ..... 36/10, 36/55, 45, 4, 14
See application file for complete search history.

(56) References Cited

U.S. PATENT DOCUMENTS

| | | | | |
|---|---|---|---|---|
| 2,003,105 | A * | 5/1935 | Caplan | 36/55 |
| 2,339,057 | A * | 1/1944 | Crofut, Jr. | 36/10 |
| 4,599,810 | A | 7/1986 | Sacre | |
| 4,809,447 | A | 3/1989 | Pacanowsky et al. | |
| 4,819,345 | A | 4/1989 | Mulcahy et al. | |
| 5,120,816 | A | 6/1992 | Gould et al. | |
| 5,289,644 | A | 3/1994 | Driskell et al. | |
| 5,334,691 | A | 8/1994 | Gould et al. | |
| RE34,890 | E | 4/1995 | Sacre | |
| 5,426,869 | A | 6/1995 | Gore et al. | |
| 5,499,459 | A | 3/1996 | Tomaro | |
| 5,526,584 | A | 6/1996 | Bleimhofer et al. | |
| 5,617,585 | A * | 4/1997 | Fons et al. | 2/239 |
| 5,647,150 | A | 7/1997 | Romanato et al. | |
| 5,659,914 | A | 8/1997 | Steinlauf | |
| 5,664,343 | A | 9/1997 | Byrne | |
| 5,678,326 | A | 10/1997 | Pavelescu | |
| 5,685,091 | A | 11/1997 | Yalamanchili | |
| 5,802,740 | A | 9/1998 | Merk, Sr. | |
| 5,918,382 | A | 7/1999 | Haderlein et al. | |
| 5,918,383 | A | 7/1999 | Chee | |
| 5,964,047 | A | 10/1999 | Covatch | |
| 6,065,227 | A | 5/2000 | Chen | |
| 6,088,935 | A | 7/2000 | Pavelescu et al. | |

(Continued)

FOREIGN PATENT DOCUMENTS

WO PCT/EP97/03550 1/1998

(Continued)

OTHER PUBLICATIONS

The Hunting Boot Guide by Georgia Sport & Trail, approximate date: Apr. 23, 2002, 22 pgs.

*Primary Examiner*—Marie Patterson
(74) *Attorney, Agent, or Firm*—Armstrong Teasdale LLP

(57) ABSTRACT

A footwear construction that includes an improved footwear upper liner is provided. The liquid impermeable footwear upper liner is constructed of air permeable, waterproof and moisture vapor transmissive materials as well as air impermeable, waterproof and moisture vapor impermeable materials. A process for constructing a footwear component utilizing the improved footwear upper liner is also provided. The process comprises providing a sole; providing an upper that together with the sole define a volume for receiving and protecting a wearer's foot against external elements and securing the improved liquid impermeable footwear upper liner within the footwear so that the footwear upper liner is located underneath the upper. In an alternative embodiment, the improved footwear upper liner is attached to a sole to form a bootie for use in footwear construction.

29 Claims, 5 Drawing Sheets

U.S. PATENT DOCUMENTS 6,305,101 B1 * 10/2001 Chemello ..... 36/10
6,410,084 B1 6/2002 Klare et al.
6,446,360 B1 9/2002 Sheets et al.
6,474,001 B1 11/2002 Chen
2002/0078593 A1 * 6/2002 Pavelescu et al. ..... 36/12
2003/0167656 A1 * 9/2003 Tung ..... 36/55
2003/0200679 A1 * 10/2003 Wilson et al. ..... 36/55

FOREIGN PATENT DOCUMENTS

WO WO 2004/098333 A2 11/2004

* cited by examiner

WATERPROOF FOOTWEAR CONSTRUCTION

BACKGROUND OF THE INVENTION

Footwear that is currently available and marketed as being "waterproof and breathable", moisture vapor permeable but not air permeable, has been found by the user to be excessively hot, wet and uncomfortable. The reason for this discomfort is that most conventional waterproof and moisture vapor transmissive footwear is not air permeable. The waterproof liner is most commonly made of a bicomponent laminate, which has one part made of monolithic polyurethane that is air impermeable. The user's foot is therefore completely sealed without access to fresh air.

The present invention is directed to overcoming this limitation on comfort caused in part by air impermeable materials and in part by moisture vapor transmitting materials. A further advantage to the present invention is the potential for reducing the proportion of expensive components while maintaining or enhancing the moisture vapor transmitting performance of the improved upper liner. Yet another advantage is to optimize the use of materials in areas of footwear that may be susceptible to wear or damage.

SUMMARY OF INVENTION

In one aspect of the invention, an improved footwear upper liner is provided. The liquid impermeable footwear upper liner is adapted to be incorporated into a footwear structure and comprises at least one air permeable, liquid water impermeable and moisture vapor transmissive first portion and at least one air impermeable, liquid water impermeable and moisture vapor impermeable second portion.

In another aspect of the invention a process for constructing a footwear component is provided. The process comprises providing a sole; providing an upper that together with the sole define a volume for receiving and protecting a wearer's foot against external elements. A liquid impermeable footwear upper liner, having at least one air permeable and moisture vapor transmissive first portion and at least one air impermeable and moisture vapor impermeable second portion is secured within the footwear so that the footwear upper liner is located within the upper of the footwear.

These are merely two illustrative aspects of the present invention and should not be deemed an all-inclusive listing of the innumerable aspects associated with the present invention. These and other aspects will become apparent to those skilled in the art in light of the following disclosure and accompanying drawings.

BRIEF DESCRIPTION OF DRAWINGS

For a better understanding of the present invention, reference may be made to the accompanying drawings in which.

DETAILED DESCRIPTION OF THE INVENTION

Figure 1:
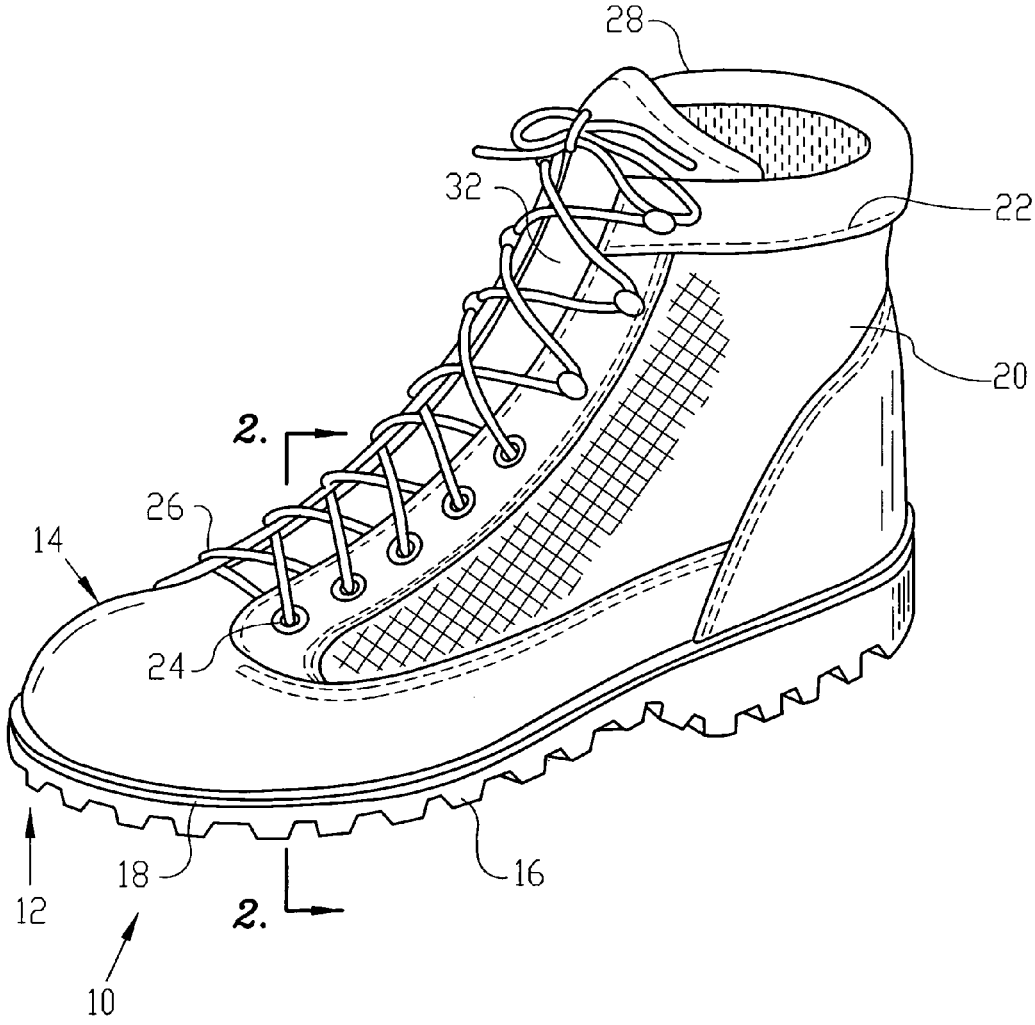
FIG. 1 is a perspective view of an illustrative, but nonlimiting, footwear construction embodying the present invention.
Figure 2:
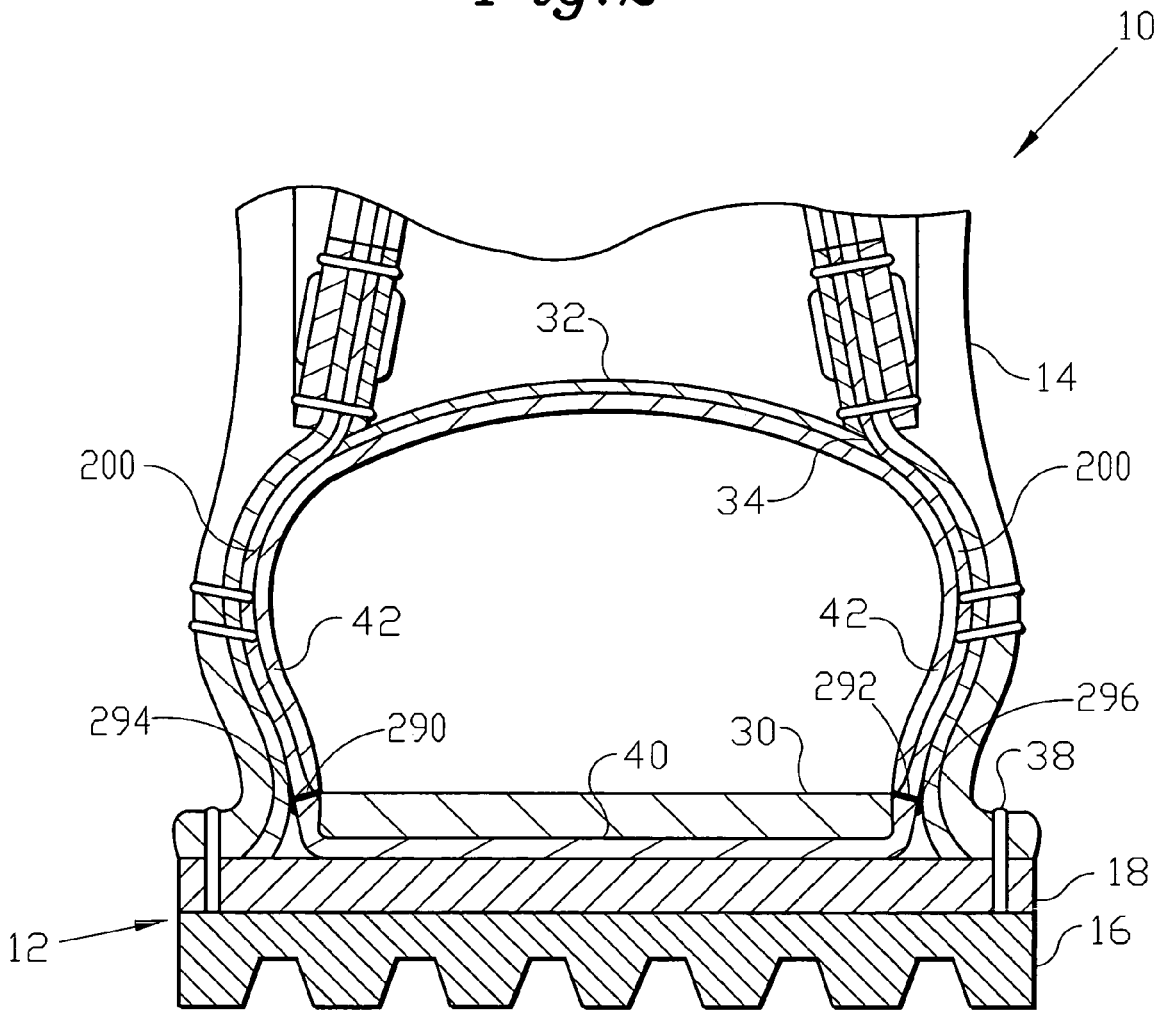
FIG. 2 is an enlarged, fragmentary, sectional view taken along Line 2—2 of FIG. 1 that illustrates one embodiment of the improved inner liner of the footwear embodying the present invention.

Referring now to FIGS. 1 and 2, an illustrative footwear item, e.g., boot, is generally indicated by numeral 10, although virtually any type of footwear can be utilized with the present invention. The footwear may be constructed of any conventional method, including double-lasting, as is well know in the art.

This illustrative footwear 10 includes both a sole 12 and a portion for receiving a human foot that is otherwise known as an upper 14. The footwear 10 typically includes a front lacing 26 that is engaged in eyelets 24. Moreover, the footwear 10 typically includes a tongue portion 32 that is preferably secured at the sides to the remainder of the footwear 10 through fold portions 34. This allows for the contraction and expansion of the upper 14 of the footwear 10 so that the user of the footwear 10 can insert and remove his or her foot. Moreover, this also provides room for adjustment so that when the front lacing 26 is secured, the footwear 10 is firmly attached to the foot of the user. For this particular type of footwear 10, in this nonlimiting embodiment, there is a top connecting strip or cap 28 that is doubled over the top of the upper 14 and preferably, but not necessarily, held in position by stitching 22. The upper 14 of the footwear 10 can be manufactured with a wide variety of materials and is preferably leather. The illustrative, but nonlimiting, embodiment can include flexible, lightweight material 20 located in cutout portions on the upper 14 of the footwear 10. The upper 14 can be secured to the sole 12 of the footwear 10 by a wide variety of attachment processes, which preferably includes adhesives.

Optionally and preferably, there is at least one layer of textile material forming an upper layer 42 located underneath the upper 14 of the footwear 10 next to the foot of the wearer of the footwear 10. A wide variety of textile fabrics can be utilized including woven, nonwoven and knit fabrics. An illustrative, but nonlimiting, type of fabric that can be utilized for this upper layer 42 is a warp knit fabric. Examples of warp knit fabrics include the ECLIPSE 100H™ (an abrasive resistant polyester and nylon combination fabric), ECLIPSE 200S™ (an abrasive resistant polyester and nylon combination fabric) and ECLIPSE 400H™ (a lightweight, nylon fabric), all manufactured by Tempo Shain Corporation, having a place of business at 27 Congress Street, Salem, Mass. 01970. Another illustrative, but nonlimiting, fabric that can be utilized for this upper layer 42 includes a three (3) bar knit fabric. Still another illustrative, but nonlimiting, fabric that can be utilized for this upper layer 42 includes a nonwoven fabric that is a combination of nylon 6 and nylon 66, which is point thermally embossed, abrasion resistant and marketed as CAMBRELLE® fabric, which is manufactured by the Faytex Corp., having a place of business at 185 Libbey Parkway, Weymouth, Mass. 02189.

Figure 3:
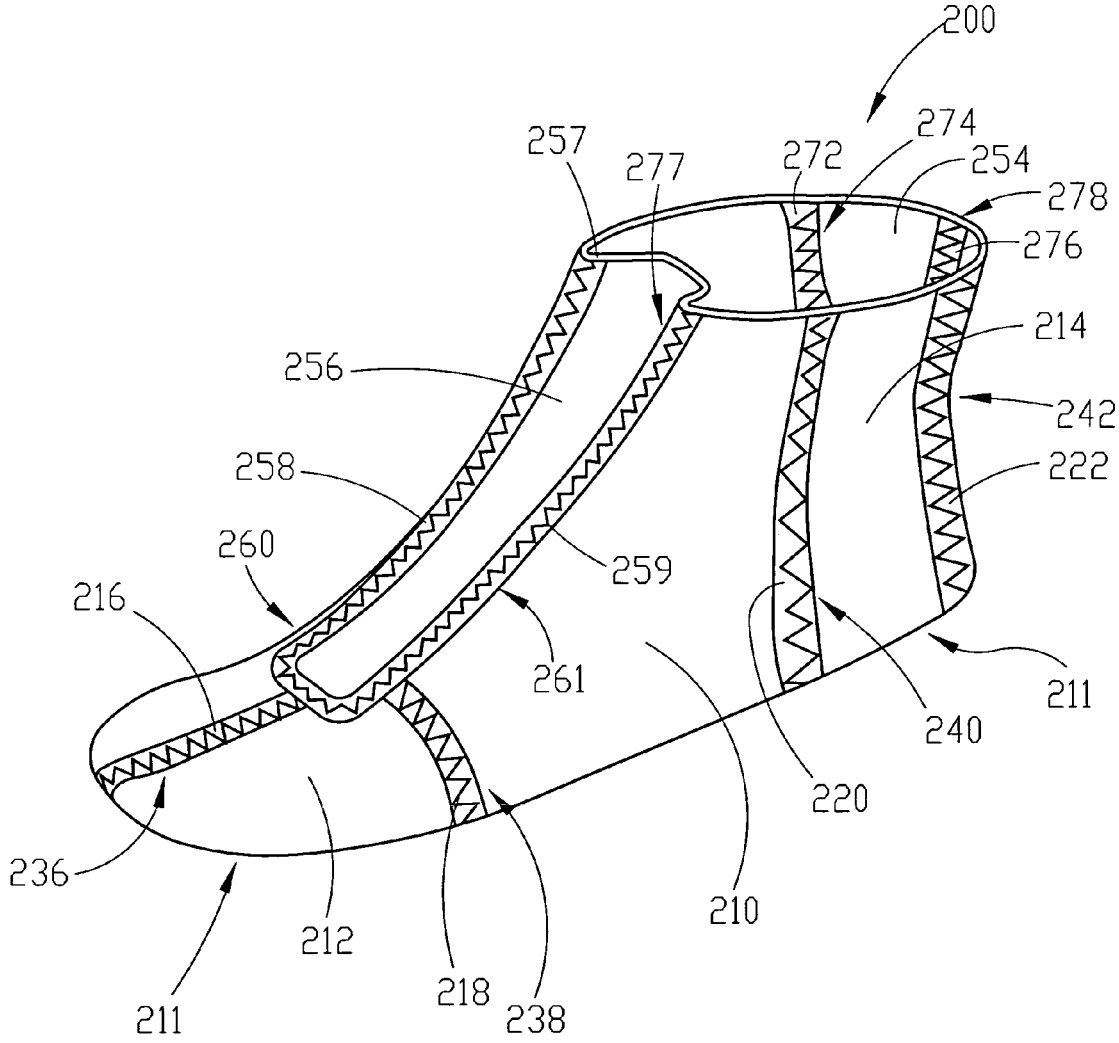
FIG. 3 is a perspective view of an embodiment of the footwear upper liner of the present invention.

Referring now to FIGS. 2 and 3, there is a footwear upper liner, which is defined as being an internal liner for the footwear 10 and is generally indicated by numeral 200, according to one embodiment of the present invention. Referring to FIG. 2, the footwear upper liner 200 is located inside the upper 14 of the footwear 10 and above the upper layer 42 (if the optional upper layer 42 is present). Optionally, there may be one or more additional layers of textile-type material that are located between the upper 14 and the footwear upper liner 200 or the footwear upper liner 200 and the upper layer 42. However, the footwear upper liner 200 may be directly attached to the upper 14 of the footwear 10. Some of these additional layers of textile material may include virtually any type of textile material including scrims, tricot knits, nonwovens, among numerous other possibilities. Illustrative, but nonlimiting, methods of attaching the footwear upper liner 200 to the upper 14 of the footwear 10 preferably includes lamination, however, adhesives and stitching may be utilized.

The sole 12 may include an outsole 16, a midsole 18 and an insole 30. A modified midsole 18 is illustrated. However, the sole 12 may combine one or more of these elements into a single unitary structure that combines one or more of these components and any permutation thereof. The upper 14 can be secured to the sole 12 of the footwear 10 by a wide variety of attachment processes, which preferably includes adhesives. In this illustrative, but nonlimiting example, the upper 14 is secured to the sole 12 of the footwear 10 by the method of stitching 38, as best illustrated in FIG. 2.

Referring now to FIG. 3, the footwear upper liner 200, is comprised of two general types of materials. A first portion, 210 of the footwear upper liner 200 is air permeable, moisture permeable and liquid impermeable. A second portion 211, typically a toe portion 212 and a heel portion 214 of the footwear upper liner 200 is air impermeable, moisture impermeable and liquid impermeable. The term "liquid impermeable" and the term "waterproof" are used interchangeably throughout the present application.

The ratio of air permeable first portion 210 to air impermeable second portion 211 is determined by the intended use of the constructed footwear, and is not limited by the following examples. A typical footwear upper liner 200 of the present invention has about 25% to about 75% first portion 210 and about 75% to about 25% second portion 211. Naturally, when the percentage of air permeable first portion 210 is decreased, the level of comfort for the user is also decreased accordingly. In a preferred embodiment the footwear upper liner 200 is about 40% to about 60% first portion 210 and about 40% to about 60% second portion 211. These percentages are based on percent area of the overall footwear upper liner.

The footwear upper liner 200, either by itself or in conjunction with a plurality of additional layers of textile-type material is liquid impermeable, which provides protection from liquid for the foot. A preferred definition of liquid impermeable is that the footwear upper liner 200 does not leak as indicated by the presence of detectable liquid on the exterior of the footwear upper liner 200 when applied with water having maximum pressure of 200 milibar (2.901 p.s.i.g.) for one (1) minute. An alternative test method is for the footwear upper liner 200, in the form of fabric laminate only, being able to pass the hydrostatic test for textile fabrics, which is a determination of the resistance to liquid penetration established by the International Organization for Standardization under ISO-811. Another applicable, but less recognized, test method is that designated ASTM D751, by the American Society for Testing and Materials. The hydrostatic resistance of the footwear upper liner 200 in the form of fabric only, while supported, is measured in accordance with Section 41 of this Test.

Preferably, the first portion 210 of footwear upper liner 200 is air permeable, which allows the human foot to breathe. Air permeability of the first portion 210 is defined by the test method designated ASTM D737-96, by the American Society for Testing and Materials. This is preferably measured by a Frazier Air Permeability Tester, a Textest FX 3300 Air Permeability Tester or an equivalent type of testing device. The air permeability needs to provide for air flow of at least 0.03 cubic centimeter per minute per square centimeter at a pressure of a 1.27 centimeter water column (0.05 cubic feet per minute per square foot at a pressure of a 0.5 inch water column) through the first portion 210 only of the footwear upper liner 200. Preferably, there is air flow of at least 0.05 cubic centimeter per minute per square centimeter at a pressure of a 1.27 centimeter water column (0.1 cubic feet per minute per square foot at a pressure of a 0.5 inch water column) through the first portion 210. More preferably there is air flow of at least 0.15 cubic centimeter per minute per square centimeter at a pressure of a 1.27 centimeter water column (0.3 cubic feet per minute per square foot at a pressure of a 0.5 inch water column) through the footwear upper liner 200 and most preferably there is air flow of at least 0.51 cubic centimeter per minute per square centimeter at a pressure of a 1.27 centimeter water column (1.0 cubic feet per minute per square foot at a pressure of a 0.5 inch water column) through the first portion 210.

The toe portion 212 and heel portion 214 are air impermeable, which means there is air flow of less than 0.03 cubic centimeter per minute per square centimeter at a pressure of a 1.27 centimeter water column (0.05 cubic feet per minute per square foot at a pressure of a 0.5 inch water column) through the toe portion 212 and the heel portion 214. The toe portion 212 and heel portion 214 are preferably made from a material that can withstand increased damage and wear typically found in these areas of the footwear 10. It is well known to those practiced in the art of footwear making that the most commonly worn (abraded) areas of the footwear upper liner 200 include the toe portion 212 and the heel portion 214. These areas can benefit from materials that are more abrasion resistant. Eliminating the constraints of air permeability and water vapor permeability greatly broadens the commercially available choices of materials to resist damage in the toe portion 212 and the heel portion 214 of the footwear upper liner 200. Extensive literature supports the use of Abrasion Resistance by the Martindale Method ASTM D4966-98 as a method of selecting materials that are more abrasion resistant.

Since the preferred embodiment of the improved of the footwear upper liner 200 utilizes a first portion 200 that can include laminates with the highest possible air permeability and moisture vapor transmission rate, the Martindale abrasion resistance in the air impermeable second portion 211, such as in the toe portion 212 and heel portion 214, is preferably higher than in the first portion 210.

In addition, the first portion 210 is moisture vapor transmissive, which allows perspiration and other vapors to exit the footwear upper liner 200 while still remaining impervious to fluids such as water. Liquid vapor permeability or the moisture vapor transmission rate of the first portion 210 is preferably defined by the test method designated JIS L 1099:1993 method B2 by the Japanese Standards Association, which provides for moisture vapor transmission of at least 500 grams per square meter (14.85 ounces per square yard) or more of water ($H_2O$) vapor in a twenty-four (24) hour period through the footwear upper liner 200. Preferably, at least 9,000 grams per square meter (267.20 ounces per square yard) or more of water ($H_2O$) vapor in a twenty-four (24) hour period passes through first portion 210 of the footwear upper liner 200. More preferably at least 15,000 grams per square meter (445.33 ounces per square yard) or more of water ($H_2O$) vapor in a twenty-four (24) hour period and most preferably at least 17,000 grams per square meter (504.71 ounces per square yard) or more of water ($H_2O$) vapor in a twenty-four (24) hour period. Such preferable materials, having more preferably at least 15,000 grams per square meter (445.33 ounces per square yard) or more of water ($H_2O$) vapor in a twenty-four (24) hour period like ECLIPSE 400H™ (a lightweight, nylon fabric) have abrasion resistance by the Martindale Method ASTM D4966-98 of less than 50,000 cycles dry to failure.

An abrasion resistance value of less than 50,000 cycles dry to failure would be appropriate for "light duty" if used throughout the footwear upper liner 200, but would fail in principal areas of wear on the footwear 10 in heavy-duty end uses. In the preferred embodiment, the second portion of the footwear upper liner 200, made with impermeable materials will have an abrasion resistance by the Martindale Method ASTM D4966-98 of at least 75,000 cycles dry to failure (1.5 times) with a preferred abrasion resistance of greater than 100,000 cycles dry to failure (2 times) and a most preferred abrasion resistance of greater than 200,000 cycles to dry failure (4 times). Such preferred abrasion resistant materials that can be utilized for the toe portion 212 and heel portion 214 of the footwear upper liner 200 that is liquid impermeable, air impermeable and moisture vapor impermeable includes nonporous, monolithic membrane laminates to ECLIPSE 200S™ (an abrasive resistant polyester and nylon combination fabric), which has a Martindale abrasion resistance (dry) of greater than 100,000 cycles to failure.

There are a number of materials that may be utilized for the first portion 210 of footwear upper liner 200. The type of material that can be utilized for the first portion 210 that is liquid impermeable, air permeable and moisture vapor transmissive includes microporous membranes. A first illustrative, but nonlimiting, example of this type of material is eVENT® Fabric, which is a chemically treated expanded polytetrafluoroethylene (hereinafter also referred to as ePTFE) membrane manufactured by BHA Technologies, Inc., having a place of business at 8800 East 63rd Street, Kansas City, Mo. 64133. Additional details regarding this technology can be found in U.S. Pat. No. 6,228,477, which issued to BHA Technologies Inc. on May 8, 2001, which is incorporated herein by reference and U.S. Pat. No. 6,410,084, which also issued to BHA Technologies Inc. on Jun. 25, 2002, which is incorporated herein by reference.

A second illustrative, but nonlimiting, example of this type of material is Gore-Tex™ XCR™, which is otherwise known as VISI000001 which is also a chemically treated ePTFE membrane manufactured by W. L. Gore & Associates, Inc., having a place of business at 555 Paper Mill Road, Newark, Del. 19711. A third illustrative, but nonlimiting, example of this type of material is TETRATEX®, which is also a ePTFE membrane, which may be chemically treated, and is manufactured by the Donaldson Company, Inc., having a place of business at P.O. Box 1299, 1400 West 94th Street, Minneapolis, Minn. 55440-1299. A fourth and fifth illustrative, but nonlimiting, example of this type of material include SUPOR® and VERSAPOR®, which are both polysulfone membranes manufactured by Pall Corporation, having a place of business at 2200 Northern Boulevard, East Hills, N.Y. 11548. A sixth illustrative, but nonlimiting, example of this type of material is PORELLE®, which is a coagulated polyurethane membrane manufactured by Porvair P.L.C. Company, having a place of business at Estuary Road, King's Lynn, Norfolk England PE30 2HS. A seventh illustrative, but nonlimiting, example of this type of material is sold under the trademark MILLIPORE®, which is also a chemically treated ePTFE membrane manufactured by the Millipore Corporation, having a place of business at 80 Ashby Road, Bedford, Mass. 01730. An eighth illustrative, but nonlimiting, example of this type of material is ENTRANT®, which is a coagulated polyurethane membrane manufactured by Toray Kabushiki Kaisha TA Toray Industries, Inc., having a place of business at 2-1, 2-chome, Nihonbashi-Muromachi Chuo-ku, Tokyo, Japan. A ninth illustrative, but nonlimiting, example of this type of material is coagulated polyurethane sold by Graboflex under the trademark FOLIO I™. A tenth illustrative, but nonlimiting, example of this type of material is a polyethylene sold under the trademarks ACE-SIL®, FLEX-SIL®, MICROPOR-SIL®, and CELLFORCE®, which are manufactured by Amerace, Microporous Products L.P. having a place of business at 596 Industrial Park Road, Piney Flats, Tenn. 37686.

In addition to microporous membranes, another type of material that can be utilized for the first portion 210 and is liquid impermeable, air permeable and moisture vapor transmissive is a select group of specialized leathers. As an illustrative, but nonlimiting, example of this type of material is a family of leather materials such as Pittards Leather, manufactured by Pittards p.l.c., having a place of business at Sherborne Road, Yeovil, Somerset, England BA21 5BA.

A first category of material that can be utilized for the toe portion 212 and heel portion 214 of the footwear upper liner 200 that is liquid impermeable, air impermeable and moisture vapor transmissive includes nonporous, bicomponent membranes. A first illustrative, but nonlimiting, example of this type of material is GORE-TEX Classic®), which is a bicomponent membrane with a layer of ePTFE and a layer of polyurethane manufactured by W. L. Gore & Associates, Inc., having a place of business at 555 Paper Mill Road, Newark, Del. 19711. A second illustrative, but nonlimiting, example of this type of material is TETRATEX®, which is also a bicomponent membrane with a layer of ePTFE and a layer of polyurethane manufactured by Donaldson Company, Inc., having a place of business at P.O. Box 1299, 1400 West 94th Street, Minneapolis, Minn. 55440-1299. A third illustrative, but nonlimiting, example of this type of material is ENTRANT®, which is a bicomponent membrane that includes coagulated polyurethane membrane and a seal coating manufactured by Toray Kabushiki Kaisha TA Toray Industries, Inc., having a place of business at 2-1, 2-chome, Nihonbashi-Muromachi Chuo-ku, Tokyo, Japan. A fourth illustrative, but nonlimiting, example of this type of material is sold by Graboflex, under the trademark FOLIO II™, which is also a bicomponent membrane that includes coagulated polyurethane with a seal coating. A fifth illustrative, but nonlimiting, example of this type of material is PORELLE®, which is also a bicomponent membrane that includes coagulated polyurethane with a seal coating manufactured by Porvair P.L.C. Company, having a place of business at Estuary Road, King's Lynn, Norfolk, England PE30 2HS.

A second category of material that can be utilized for the toe portion 212 and heel portion 214 that is liquid impermeable, air impermeable and moisture vapor transmissive includes nonporous, monolithic membranes. A first illustrative, but nonlimiting, example of this type of material is DERMIZAC™, which is a monolithic polyurethane membrane manufactured by Toray Kabushiki Kaisha TA Toray Industries, Inc., having a place of business at 2-1, 2-chome, Nihonbashi-Muromachi Chuo-ku, Tokyo, Japan. A second illustrative, but nonlimiting, example of this type of material is HYTREL®, which is also a monolithic polyurethane membrane, which is manufactured by E. I. Du Pont de Nemours & Company, having a place of business at 1007 Market Street, Wilmington, Del. 19898. A third illustrative, but nonlimiting, example of this type of material is also a monolithic polyurethane membrane manufactured under the trademark DERMAFLEX™. A fourth illustrative, but nonlimiting, example of this type of material is DIAPLEX®, which is also a monolithic polyurethane membrane, manufactured by Mitsubishi Jukogyo Kabushiki Kaisha Ta Mitsubishi Heavy Industries, Ltd., having a place of business at Marunochi 2-Chome, Chiyoda-Ku, Tokyo, Japan.

A third category of material that can be utilized for the toe portion 212 and heel portion 214 that is liquid impermeable, air impermeable and moisture vapor impermeable and includes nonporous, monolithic material but is not limited to polymeric membranes such as polyvinyl chloride, polyurethane, poly(ethylene terephthalate) and polyester.

A non-limiting embodiment of the present invention footwear upper liner 200 is shown in FIG. 3. This particular embodiment includes a tongue portion 256 and an opening 254 that conforms to upper 14 of footwear 10. The tongue portion 256 conforms to the tongue portion 32 for the upper 14 of the footwear 10 so that the upper 14 can expand and contract when a human foot is either inserted into the footwear 10 or removed from the footwear 10. The tongue portion 256 is joined through seams 258, 259 at tongue portion 256 folds 257, 277. The first portion 210, the toe portion 212 and the heel portion 214 are joined together at seams 216, 218, 220, 222, 272, 276, 258 and 259. The seams 216, 218, 220, 222, 272, 276, 258 and 259 can be made by any of a wide variety of thread-type material in the form of strands or cords and include spun fibers, spun fibers encircling a core filament, bonded fibers and monofiliment-type material that may or may not be coated with a liquid impermeable coating. In addition, adhesives may be utilized as well as electro-die sealing methods. It is also understood that the location and number of the seams 216, 218, 220, 222, 272, 276, 258 and 259 can vary tremendously depending on the type of footwear 10.

Also, seams can be sealed with seam tapes 236, 238, 240, 242, 274, 278, 260 and 261 positioned over the seams 216, 218, 220, 222, 272, 276, 258 and 259 respectively, heat applied through the application of hot air and pressure through a nip roll is then applied to the top of the seam tapes 236, 238, 240, 242, 274, 278, 260 and 261. The heat from the hot air is preselected to soften the adhesive in the seam tapes 236, 238, 240, 242, 274, 278, 260 and 261 without detrimentally affecting any of the desired qualities found in the footwear upper liner 200 of the footwear 10. An application of heat preferably ranges from about 150 degrees Celsius (302 degrees Fahrenheit) to about 250 degrees Celsius (482 degrees Fahrenheit) for most applications. A preferred application of pressure is from about 3 kilograms per square centimeter (42.67 pounds per square inch) gauge to about 5 kilograms per square centimeter (71.12 pounds per square inch) gauge such as that applied by a PFAFF® seam making machine. PFAFF® is a registered trademark of Pfaff Industrie Maschinen GmbH, having a place of business at Königstr. 154, 67655 Kaiserslautern, Germany. However, the applied temperature and pressure are completely dependent on the type of material used for the footwear upper liner 200, the threads used to create the seams 216, 218, 220, 222, 272, 276, 258 and 259, the adhesives and the type of material utilized for the seam tapes 236, 238, 240, 242, 274, 278, 260 and 261. By such a process, a solid structural weld is formed that provides at least a liquid impermeable quality in the seams 216, 218, 220, 222, 272, 276, 258 and 259 to virtually the same extent as the remainder of the footwear upper liner 200 and the sole liner 40 with the seams 216, 218, 220, 222, 272, 276, 258 and 259 covered and sealed.

An illustrative, but nonlimiting, example of this type of seam tape, utilized as seam tapes 236, 238, 240, 242, 274, 278, 260 and 261, includes a three (3) layer MF-12™ manufactured by Nisshinbo Industries, Inc., having a place of business at 31-11 Nihonbashi Ningyo-cho 2-chome Chuo-ku, Tokyo, Japan. A second illustrative, but nonlimiting, example of this type of seam tape, utilized as seam tapes 236, 238, 240, 242, 274, 278, 260 and 261, includes Model 2000 manufactured by Melco Embroidery Systems, having a place of business at 1575 West 124th Avenue, Denver, Colo. 80234. A third illustrative, but nonlimiting, example of this type of seam tape, utilized as seam tapes 236, 238, 240, 242, 274, 278, 260 and 261, includes Model ST-302 manufactured by Bemis Manufacturing Company, having an address at 1 Bemis Way PO Box 717, Shirley Mass. 53085-0901.

Figure 4:
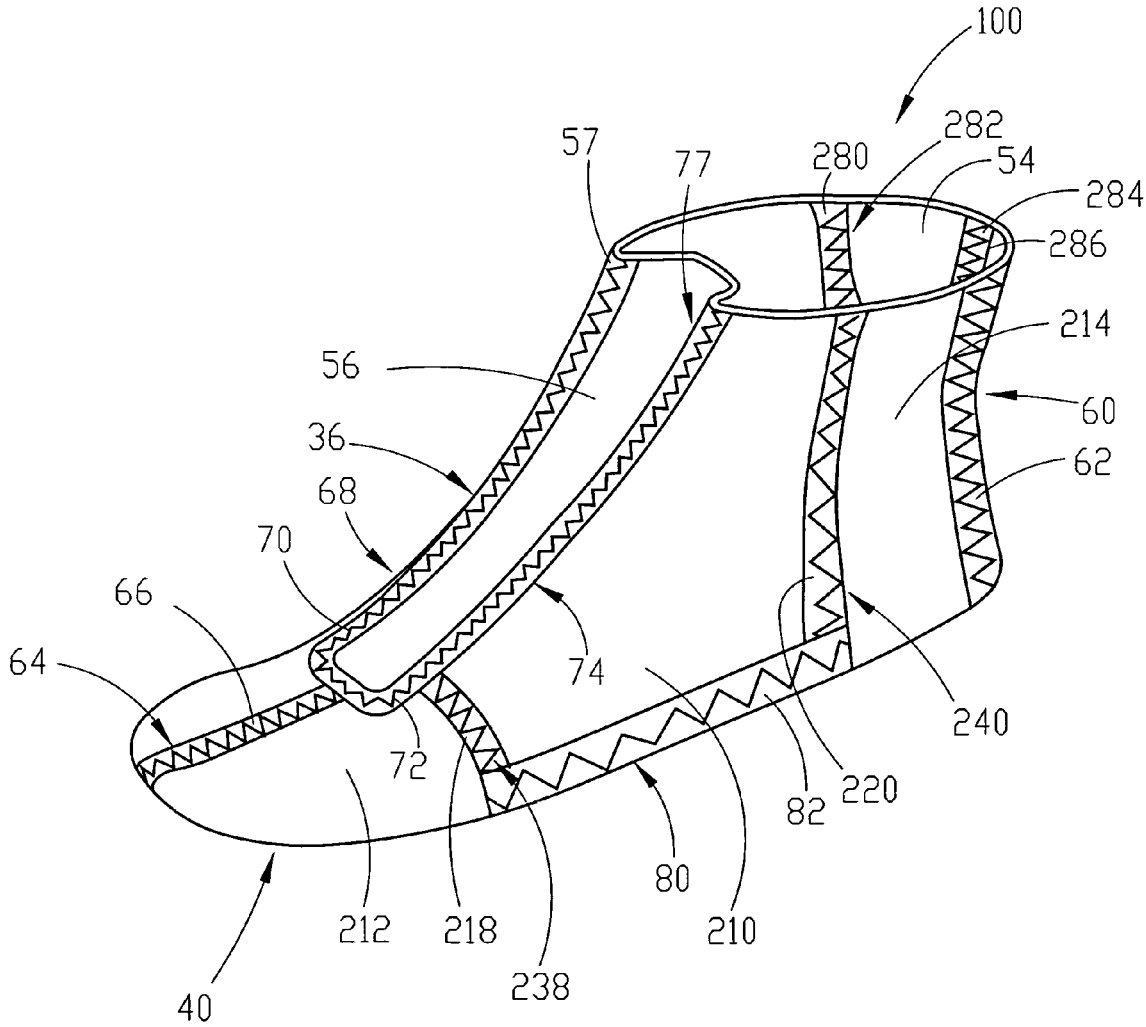
FIG. 4 is a perspective view of an alternative embodiment of the footwear upper liner of the present invention.

In an alternative embodiment, a footwear upper liner 36 can be seamed with a sole liner 40 to form a bootie 100 as seen in FIG. 4. The bootie 100 includes a top opening 54 that conforms to the upper 14 for the footwear 10 and includes a tongue portion 56 having fold portions 57, 77. The tongue portion 56 of the footwear upper liner 100 conforms to the tongue portion 32 for the upper 14 of the footwear 10 so that the upper 14 can expand and contract when a human foot is either inserted into the footwear 10 or removed from the footwear 10. The bootie 100 is seamed together at seams 62, 66, 70, 72, 280, 284 and 82 with seam tapes 60, 64, 68, 74, 282, 286 and 80, respectively, preferably around the perimeter. The seam tapes are preferably liquid impermeable and are formed of the materials and by the methods as described above for footwear upper liner 200.

Figure 5:
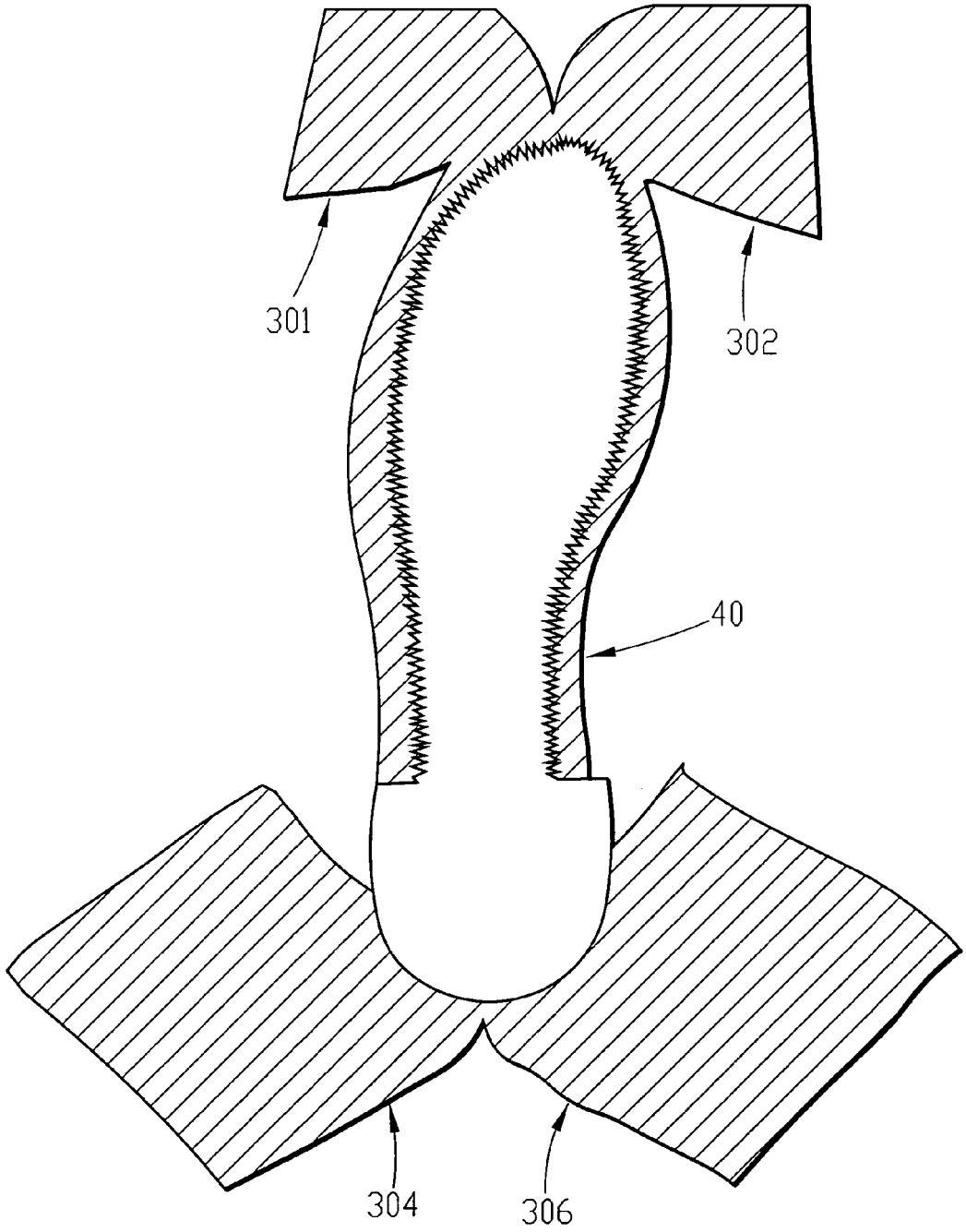
FIG. 5 is a top plan view that illustrates the sole liner according to one embodiment of the present invention prior to being shaped into a usable configuration.

In the embodiment illustrated, the sole liner 40 and the toe portion 212 and heel portion 214 are cut from a single piece, as is seen in FIG. 4 This embodiment is merely for illustration, as the sole liner 40, toe portion 212 and heel portion 214 can be made from separate pieces, or from separate materials. This allows the sole liner 40 to be formed of a material that may be less suitable for the footwear upper liner 36 for the particular use desired. For example, as shown in FIG. 5, the sole liner 40 can include a first toe portion 301, a second toe portion 302, a first heel portion 304 and a second heel portion 306.

In either case, the sole liner 40 is, but not limited to, impervious to both moisture vapor and air. A preferred definition of liquid impermeable is that the sole liner 40 does not leak as indicated by detectable liquid on the exterior of the sole liner 40 when applied with water having maximum pressure of 200 mbar (0.5 p.s.i.g.) for one (1) minute. An alternative test method is for the sole liner 40, in the form of fabric laminate or coated fabric only, being able to pass the hydrostatic test for textile fabrics, which is a determination of the resistance to liquid penetration established by the International Organization for Standardization under ISO-811. Another applicable, but less recognized, test method is that designated ASTM D751, by the American Society for Testing and Materials. The hydrostatic resistance of the sole liner 40 in the form of fabric only, while supported, is measured in accordance with Section 41 of this Test. In the preferred embodiment as shown in FIG. 2, when the sole liner 40 is in the form of fabric laminate or coated fabric, the sole liner 40 can be attached to the footwear upper liner 200 by seam 290 and seam 292 in conjunction with seam tapes 294 and 296, respectively.

In the absence of air permeability of the sole liner 40 is defined by the test method designated ASTM D737-96, by the American Society for Testing and Materials. This is preferably measured by a Frazier Air Permeability Tester, a Textest FX 3300 Air Permeability Tester or an equivalent type of testing device. The air permeability needs to provide for air flow of less than 0.03 cubic centimeter per minute per square centimeter at a pressure of a 1.27 centimeter water column (0.05 cubic feet per minute per square foot at a pressure of a 0.5 inch water column) through the sole liner 40.

In addition, the sole liner 40 is impervious to moisture vapor transmission. Liquid vapor permeability or the moisture vapor transmission rate of the sole liner 40 is preferably defined by the test method designated JIS L 1099:1993 B2 by the Japanese Standards Association, which provides for less than 500 grams per square meter (14.85 ounces per square yard) of water ($H_2O$) vapor in a twenty-four (24) hour period through the sole liner 40.

In addition, the sole liner 40 is preferably inelastic. "Inelasticity" is defined as material that when subjected to a stress-strain test will not provide 100% recovery when deflected more than 10% from the yield point.

A first category for the type of materials that can be utilized for the sole liner 40 includes inelastic, thermoplastic material, e.g., sheet goods. This can include, but is not limited to: polypropylene; polyethylene; polyester; inelastic polyurethane; nylon; and vinyl. A second category of material for the sole liner 40, includes fiber reinforced polymeric materials. This can include fibers made of: polyester; nylon; polypropylene; polyethylene; rayon; cotton; and the like, as illustrative, but nonlimiting, examples. A third category of material for the sole liner 40, includes all nonthermoplastic material. This can include as illustrative, but nonlimiting, examples: reactive polyurethane; epoxy; styrene; butadiene; acrylic(s); and vulcanized rubber.

A first nonlimiting, but illustrative, example of this material utilized in the sole liner 40 includes BONTEX® manufactured by Bontex, Inc., having a place of One Bontex Drive, Buena Vista, Va. 24416. A second illustrative, but nonlimiting, example of this material utilized in the sole liner 40 includes that manufactured by Foss, Inc., having a place of 380 Lafayette Road, P.O. Box 5000, Hampton, N.H. 03843-5000. A third illustrative, but nonlimiting, example of this material utilized in the sole liner 40 is UPACO™ manufactured by Worthen Industries, Inc., having a place of business at 3 East Spit Brook Road, Nashua, N.H. 03060. A fourth illustrative, but nonlimiting, example of this material utilized in the sole liner 40 is SOVERE™ manufactured by Sovere s.r.l., having a place of business at Via della Metallurgia, 24-37139, Verona, Italy. A fifth illustrative, but nonlimiting, example of this material utilized in the sole liner 40 is MOREL™ manufactured by Industria Chemica, having a place of business at Gradisca 18, 20151 Milano, Italy. A sixth nonlimiting, but illustrative, example of this material utilized in the sole liner 40 is ALCANTARA®, manufactured by Alcantara S.p.A., having a place of business at 1 Via Mozart, 20122 Milan, Italy. A seventh illustrative, but nonlimiting, example of this material utilized in the sole liner 40 is VITA™, manufactured by 2001 Giovanni Crespi S.p.A. having a place of business at Via Pasubio, 38 20025 Legnano, Milan, Italy. An eighth illustrative, but nonlimiting, example of this type of material utilized in the sole liner 40 is Rhenoflex® manufactured by Rhenoflex GmbH, having a place of business at P.O. Box 150480, 67029 Ludwigshafen am Rhein, Germany. A ninth illustrative, but nonlimiting, example of this type of material utilized in the sole liner 40 is manufactured by Quinorgan International, having a place of business at Poligono Industrial Pla d'en coll C/Fresser, 21-23 08110, Montcada i Reixach Spain. A tenth illustrative, but nonlimiting, example of this type of material utilized in the sole liner 40 is manufactured by Forestali, having a place of business at Via-Kennedy, 75 20010 Marcallo con Casone MI, Italy. An eleventh illustrative, but nonlimiting, example of this type of material utilized in the sole liner 40 is manufactured by Bartoli, having a place of business at Via Traversa di Parezzana 12/14/16-I 55061 Carraia Lucca, Italy. A twelfth illustrative, but nonlimiting, example of this type of material utilized in the sole liner 40 is FOOTLEVERS® manufactured by Foot Levelers, Inc., having a place of business at 518 Pocahontas Ave. N.E., Roanoke Va. 24027-2611. A thirteenth illustrative, but nonlimiting, example of this type of material utilized in the sole liner 40 is manufactured by Polymer Dynamics, Inc., having a place of business at 2200 S. 12th Street, Allentown, Pa. 18103.

The sole liner 40 can also be moisture permeable. In a first illustrative, but nonlimiting, example of this material, which may be moisture vapor permeable, utilized in the sole liner 40 is PORELLE®, which is manufactured by Porvair P.L.C. Company, having a place of business at Estuary Road, King's Lynn, Norfolk, England PE30 2HS. A second illustrative, but nonlimiting, example of this material utilized in the sole liner 40 is PORON® manufactured by the Rogers Corporation, having a place of business at One Technology Drive, Rogers, Conn. 06263. A third illustrative, but nonlimiting, example of this material utilized in the sole liner 40 is TEXON® manufactured by Texon U.S.A., Inc., having a place of business at 400 Research Drive, Wilmington, Mass. 01887 as well as having a place of business at 100 Ross Walk, Leicester, LE4 5BX, England.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered covered by the claims in this present patent application when those modified forms fall within the claimed scope of this invention.

The invention claimed is:

1. A footwear upper liner adapted to be incorporated into a footwear structure, having an upper and a sole, the footwear upper liner comprising:

at least one waterproof, air permeable and moisture vapor transmissive first portion; and at least one waterproof, air impermeable and moisture vapor impermeable second portion, wherein the at least one second portion is comprised of a section that substantially surrounds a user's toes and a second section that substantially surrounds a user's heel, and the at least one first portion comprises the remainder of the footwear upper liner.

2. The footwear upper liner according to claim 1, wherein the at least one first portion of the footwear upper liner includes a microporous membrane.

3. The footwear upper liner according to claim 2, wherein the microporous membrane is selected from the group consisting of an expanded polytetrafluoroethylene, a polysulfone membrane, a coagulated polyurethane membrane and a polyvinyl chloride membrane.

4. The footwear upper liner according to claim 1, wherein the at least one second portion includes a bicomponent membrane selected from the group comprising expanded polytetrafluoroethylene with a layer of polyurethane and a layer of coagulated polyurethane with a seal coating.

5. The footwear upper liner according to claim 1, wherein the at least one second portion includes a nonporous, monolithic membrane selected from the group consisting of polyurethane, polyvinyl chloride, poly (ethylene terepbthalate) and polyester.

6. The footwear upper liner according to claim 1, wherein the at least one second portion allows for air flow of less than 0.03 cubic centimeter per minute per square centimeter at a pressure of a 1.27 centimeter water column (0.05 cubic feet per minute per square foot at a pressure of a 0.5 inch water column) and the at least one first portion allows for moisture vapor transmission of at least 500 grams per square meter (14.85 ounce per square yard) of water ($H_2O$) vapor in a twenty-four (24) hour period.

7. The footwear upper liner according to claim 1, wherein the at least one second portion allows for air flow of less than 0.05 cubic centimeter per minute per square centimeter at a pressure of a 1.27 centimeter water column (0.05 cubic feet per minute per square foot at a pressure of a 0.5 inch water column) and the at least one second portion allows for moisture vapor transmission of less than 500 grams per square meter (14.85 ounces per square yard) of water ($H_2O$) vapor in a twenty-four (24) hour period.

8. The footwear upper liner according to claim 1, wherein the footwear upper liner does not leak as indicated by detectable water on the footwear upper line?s exterior when applied with water having a maximum pressure of 200 milibar (2.901 p.s.i.g.) for one (1) minute.

9. The footwear upper liner according to claim 1, wherein the at least one first portion allows for air flow of at least 0.03 cubic centimeter per minute per square centimeter at a pressure of a 1.27 centimeter water column (0.0591 cubic feet per minute per square foot at a pressure of a 0.5 inch water column) and the at least one first portion allows for moisture vapor transmission of at least 500 grams per square meter (14.85 ounces per square yard) or more of water ($Fl_2O$) vapor in a twenty-four (24) hour period.

10. The footwear upper liner according to claim 1, wherein the at least one first portion allows for air flow of at least 0.05 cubic centimeter per minute per square centimeter at a pressure of a 1.27 centimeter water column (0.0985 cubic feet per minute per square foot at a pressure of a 0.5 inch water column) and the at least one first portion allows for moisture vapor transmission of at least 9,000 grams per square meter (267.20 ounces per square yard) or more of water ($H_2O$) vapor in a twenty-four (24) hour period.

11. The footwear upper liner according to claim 1, wherein the at least one first portion allows for air flow of at least 0.15 cubic centimeter per minute per square centimeter at a pressure of a 1.27 centimeter water column (0.2955 cubic feet per minute per square foot at a pressure of a 0.5 inch water column) and the at least one first portion allows for moisture vapor transmission of at least 15,000 grams per square meter (445.33 ounces per square yard) or more of water ($H_2O$) vapor in a twenty-four (24) hour period.

12. The footwear upper liner according to claim 1, wherein the at least one first portion allows for air flow of at least 0.51 cubic centimeter per minute per square centimeter at a pressure of a 1.27 centimeter water column (1.0 cubic feet per minute per square foot at a pressure of a 0.5 inch water column) and the footwear upper liner allows for moisture vapor transmission of at least 17,000 grams per square meter (504.71 ounces per square yard) or more of water ($H_2O$) vapor in a twenty-four (24) hour period.

13. The footwear upper liner according to claim 1, wherein the at least first portion comprises about 75% to about 25% of the footwear upper liner and wherein the at least second portion comprises about 25% to about 75% of the footwear upper liner.

14. The footwear upper liner according to claim 1, wherein the at least first portion comprises about 40% to about 60% of the footwear upper liner and wherein the at least second portion comprises about 40% to about 60% of the footwear upper liner.

15. A footwear upper liner adapted to be incorporated into a footwear structure, the footwear upper liner comprising:

at least one first portion that is air permeable, moisture vapor transmissive and liquid impermeable and includes a microporous membrane; and at least one second portion that is air impermeable, moisture vapor impermeable and liquid impermeable, the at least one second portion being selected from the group consisting of inelastic, thermoplastic material, fiber reinforced polymeric material and nonthermoplastic material, wherein the at least one second portion is comprised of a section that substantially surrounds a user's toes and a second section that substantially surrounds a user's heel, and the at least one first portion comprises the remainder of the footwear upper liner.

16. A footwear upper liner adapted to be incorporated into a footwear structure, having an upper an sole, which comprises:

at least one first portion that is air permeable, moisture vapor transmissive and liquid impermeable and the footwear upper liner allows for air flow of at least 0.03 cubic centimeter per minute per square centimeter at a pressure of a 1.27 centimeter water column (0.05 cubic feet per minute per square foot at a pressure of a 0.5 inch water column) and the footwear upper liner allows for moisture vapor transmission of at least 500 grams per square meter (14.85 ounces per square yard) or more of water (1120) vapor in a twenty-four (24) hour period and includes a microporous membrane; and at least one second portion that is inelastic, air impermeable, moisture vapor impermeable and liquid impermeable and the sole liner allows for air flow of less than 0.03 cubic centimeter per minute per square centimeter at a pressure of a 1.27 centimeter water column (0.05 cubic feet per minute per square foot at a pressure of a 0.5 inch water column) and the sole liner allows for moisture vapor transmission of less than 500 grams per square meter (14.85 ounces per square yard) of water ($H_2O$) vapor in a twenty-four (24) hour period and the sole liner is selected from the group consisting of inelastic, thermoplastic material, fiber reinforced polymeric material and nonthermoplastic material, wherein the at least one second portion is comprised of a section that substantially surrounds a user's toes and a second section that substantially surrounds a user's heel, and the at least one first portion comprises the remainder of the footwear upper liner.

17. A bootie adapted to be incorporated into a footwear structure, having an upper and a sole, which comprises:

an upper liner comprising at least one air permeable and moisture vapor transmissive first portion and at least one air impermeable and moisture vapor impermeable second portion; and a sole liner that is air impermeable, moisture vapor impermeable and liquid impermeable, wherein the footwear upper liner is attached to the sole liner, wherein the at least one second portion is comprised of a section that substantially surrounds a user's toes and a second section that substantially surrounds a user's heel, and the at least one first portion comprises the remainder of the footwear upper liner.

18. The bootie according to claim 17, wherein the sole liner is inelastic.

19. The bootie according to claim 17, wherein the sole liner will not fully recover when deflected more than ten percent (10%) from a point of yield.

20. The bootie according to claim 17, wherein the sole liner includes material selected from the group consisting of an inelastic, thermoplastic material, a fiber reinforced polymeric material and a nonthermoplastic material.

21. The bootie according to claim 20, wherein the inelastic, thermoplastic material is selected from the group consisting of polypropylene, polyethylene, polyester, inelastic polyurethane, nylons and vinyl and the fiber reinforced polymeric material is selected from the group consisting of fibers of polyester, nylon, polypropylene, polyethylene, rayon, and cotton and the nonthermoplastic material is selected from the group consisting of reactive polyurethane, epoxy, styrene, butadiene, acrylics and vulcanized rubber.

22. A footwear upper liner adapted to be incorporated into a footwear structure, having an upper and a sole, the footwear upper liner comprising:

at least one first portion that is air permeable, moisture vapor transmissive and liquid impermeable and includes a microporous membrane; and at least one second portion that is air impermeable, moisture vapor impermeable and liquid impermeable, wherein the at least one second portion has a higher Martindale abrasion resistance value than the at least one first portion, wherein the at least one second portion is comprised of a section that substantially surrounds a user's toes and a second section that substantially surrounds a user's heel, and the at least one first portion comprises the remainder of the footwear upper liner.

23. The footwear upper liner according to claim 22, wherein the at least one second portion has a Martindale abrasion resistance value that is at least 1.5 times a Martindale abrasion resistance value of the at least one first portion.

24. A process for producing a footwear component comprising:

providing a sole;

providing an upper that together with the sole define a volume for receiving and protecting a wearer's foot against external elements; and securing a liquid impermeable footwear upper liner, having at least one air permeable and moisture vapor transmissive first portion and at least one air impermeable and moisture vapor impermeable second portion within the footwear so that the at least one second portion is comprised of a section that substantially surrounds a user's toes and a second section that substantially surrounds a user's heel, and the at least one first portion comprises the remainder of the footwear upper liner.

25. The process for producing a footwear component according to claim 24, further comprising:

securing at least one layer of textile material either outside or inside the upper liner.

26. The process for producing a footwear component according to claim 24, wherein the at least one first portion includes a microporous membrane.

27. The process for producing a footwear component according to claim 24, wherein the at least one second portion is selected from the group consisting of an inelastic, thermoplastic material, a fiber reinforced polymeric material and a nonthermoplastic material.

28. The process for producing a footwear component according to claim 24, wherein the at least one first portion allows for air flow of at least 0.03 cubic centimeter per minute per square centimeter at a pressure of a 1.27 centimeter water column (0.05 cubic feet per minute per square foot at a pressure of a 0.5 inch water column) and the at least one first portion allows for moisture vapor transmission of at least 500 grams per square meter (14.85 ounces per square yard) or more of water (1120) vapor in a twenty-four (24) hour period and the at least one second portion allows for air flow of less than 0.03 cubic centimeter per minute per square centimeter at a pressure of a 1.27 centimeter water column (0.05 cubic feet per minute per square foot at a pressure of a 0.5 inch water column) and the at least one second portion allows for moisture vapor transmission of less than 500 grams per square meter (14.85 ounces per square yard) of water (1120) vapor in a twenty-four (24) hour period.

29. A process for producing a footwear component comprising:

providing a sole;

providing an upper that together with the sole define a volume for receiving and protecting a wearer's foot against external elements; and securing a liquid impermeable bootie, having a footwear upper liner comprised of at least one air permeable and moisture vapor transmissive first portion and at least one air impermeable and moisture vapor impermeable second portion, the footwear upper liner being attached to a sole liner, within the footwear so that the at least one second portion is comprised of a section that substantially surrounds a user's toes and a second section that substantially surrounds a user's heel, and the at least one first portion comprises the remainder of the footwear upper liner, wherein the sole liner is air impermeable, moisture vapor impermeable and liquid impermeable.

* * * * *